US006209641B1

(12) United States Patent
Stevenson

(10) Patent No.: US 6,209,641 B1
(45) Date of Patent: Apr. 3, 2001

(54) METHOD AND APPARATUS FOR PRODUCING FLUIDS WHILE INJECTING GAS THROUGH THE SAME WELLBORE

(75) Inventor: Mark D. Stevenson, Anchorage, AK (US)

(73) Assignee: Atlantic Richfield Company, Los Angeles, CA (US)

( * ) Notice: Subject to any disclaimer, the term of this patent is extended or adjusted under 35 U.S.C. 154(b) by 0 days.

(21) Appl. No.: 09/430,598

(22) Filed: Oct. 29, 1999

(51) Int. Cl.[7] ..... E21B 43/40
(52) U.S. Cl. ..... 166/266; 166/305.1; 166/105.5
(58) Field of Search ..... 166/265, 266, 166/105.5, 106, 313, 306, 305.1, 268

(56) References Cited

U.S. PATENT DOCUMENTS 5,431,228 7/1995 Weingarten et al. .
5,482,117 1/1996 Kolpak et al. .
5,605,193 2/1997 Bearden et al. .
5,730,871 3/1998 Kennedy et al. .
5,794,697 8/1998 Wolflick et al. .
6,033,567 * 3/2000 Lee et al. ..... 210/512.2
6,068,053 * 5/2000 Shaw ..... 166/267
6,082,452 * 7/2000 Shaw et al. ..... 166/105.5

* cited by examiner

*Primary Examiner*—Frank S. Tsay
(74) *Attorney, Agent, or Firm*—Albert C. Metrailer

(57) ABSTRACT

Method and apparatus for producing a first zone through a wellbore while simultaneously injecting gas into a second zone through the same wellbore. The production stream is produced to the surface through a string of tubing where gas is separated therefrom. The separated gas and/or gas from another source is then mixed with a carrier fluid (e.g. produced water, etc.) to form a mixture which, in turn, is pumped down the well annulus and through a downhole separator (e.g. an inverted hydrocyclone) where at least a portion of the gas is separated from the mixture. The separated gas is injected into the second zone while the remaining mixture is commingled with the production stream before the combined streams flow to the surface through the tubing.

11 Claims, 1 Drawing Sheet

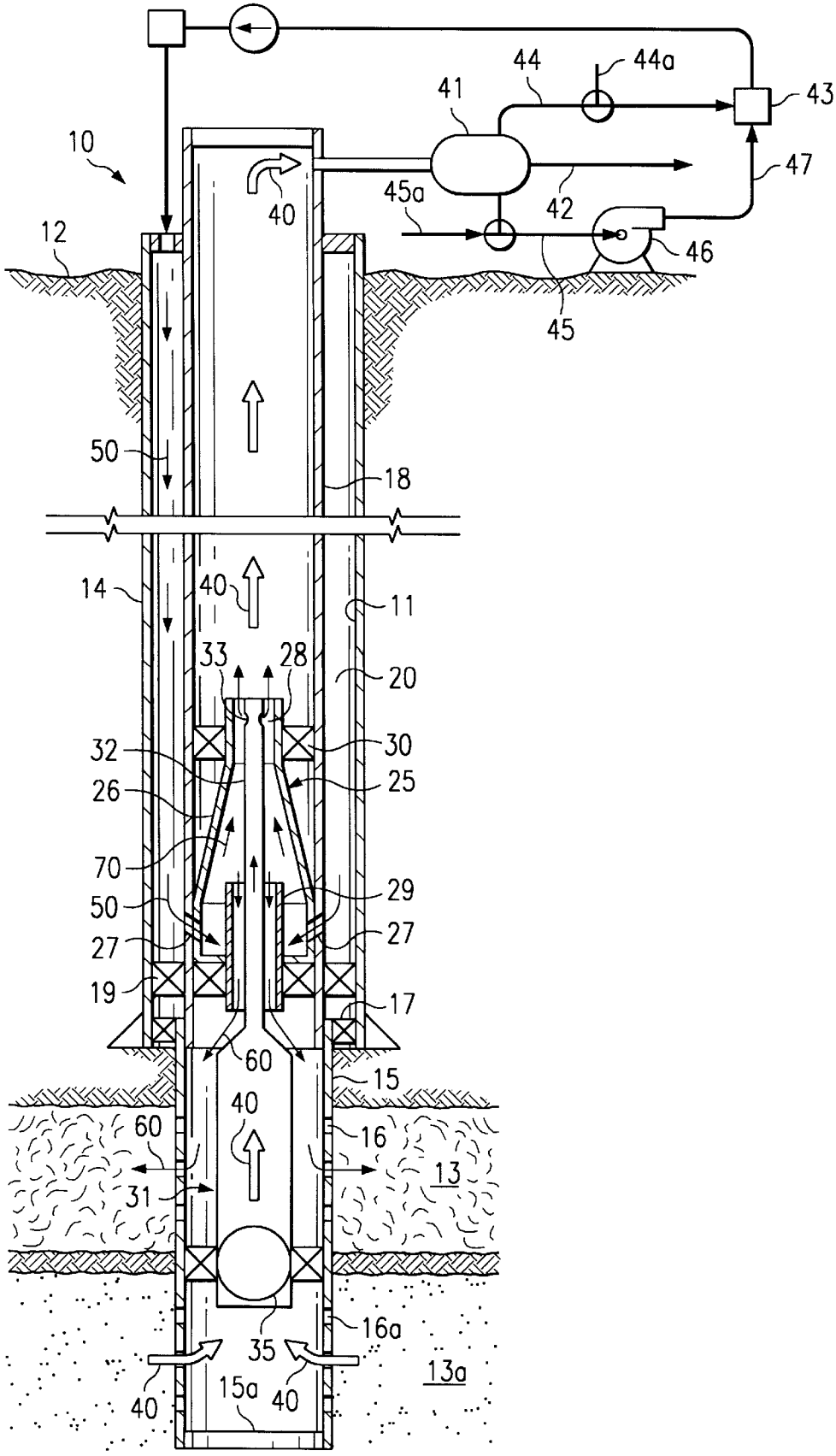
10
12
40
41
44
44a
43
47
45a
42
46
45
50
18
14
40
11
33
28
20
32
30
26
25
70
29
50
27
27
19
17
60
15
40
60
16
13
31
35
16a
13a
40
15a
40

METHOD AND APPARATUS FOR PRODUCING FLUIDS WHILE INJECTING GAS THROUGH THE SAME WELLBORE

DESCRIPTION

1. Technical Field

The present invention relates to a method and apparatus for producing through a wellbore while simultaneously injecting gas into a subterranean formation through the same wellbore and in one aspect relates to a method and apparatus for injecting gas into a formation wherein the gas is mixed with a carrier fluid at the surface which, in turn, is flowed down a well where at least a portion of the gas is separated and injected into the formation while fluids are being produced through the wellbore.

2. Background

It is well known that many hydrocarbon reservoirs produce extremely large volumes of gas along with crude oil and other liquids. In producing fields such as these, it is not unusual to experience gas-to-oil ratios (GOR) as high as 25,000 standard cubic feet per barrel (scf/bbl.) or greater. As a result, large volumes of gas must be separated out of the liquids before the liquids are transported to storage or for further processing. Where the production sites are near or convenient to large markets, this gas is considered a valuable asset when demands for gas are high. However, when demands are low or when the producing reservoir is located in a remote area, the produced gas can present major problems since production may have to shut-in or at least drastically reduced if the gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which often overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored" in an appropriate, subterranean permeable formation from which it can later be recovered when the situation dictates.

To reinject the gas, large and expensive separation and compression surface facilities must be built at or near the production site. A major economic consideration in such facilities is the relatively high costs of the gas compressor train which is needed to compress the large volumes of produced gas to the pressures required for injection. As will be understood in this art, significant cost savings can be achieved if the gas compressor requirements can be downsized or eliminated altogether. To achieve this, however, it is necessary to either raise the pressure at the surface by some means other than mechanical compression or else reduce the pressure required at the surface for injection of the gas downhole.

Recently, several techniques have been proposed for disposing of at least a part of the produced gas by separating the gas at the surface and then injecting it through the production wellbore into a subterranean formation. For example, in co-pending and commonly assigned U.S. patent application Ser. No. 09/072,657, filed May 5, 1998 a method and apparatus are disclosed wherein gas, which has been separated from a production stream, is mixed with a with a carrier liquid (e.g. brine) to form a dense mixture which, in turn, is flowed downward in a wellbore of an injection well. The mixture flows through a downhole separator in the wellbore to thereby separate at least a portion of the gas from the mixture. The separated gas is then injected into a formation adjacent the wellbore while the carrier liquid and any unseparated gas is returned to the surface. By mixing the gas with a carrier liquid, the need for expensive gas compressors at the surface is eliminated. However, this method requires a dedicated injection well.

Another similar method for disposing of produced gas is disclosed in co-pending and commonly assigned U.S. patent application Ser. No. 09/073,215, filed May 5, 1998 wherein a common wellbore is used for both producing an oil and gas stream and for re-injecting at least a portion of the produced gas. The production stream passes through a separator as it is being produced to the surface to thereby separate at least a portion of the gas from the production stream which, in turn, is then flowed to the surface. After a production cycle, the well is shut-in and the separated gas is the flowed down the same wellbore to be injected into an formation different from the production formation.

The gas is first mixed with a carrier fluid, e.g. brine, at the surface to form a dense mixture which, in turn, is flowed through the downhole separator in the wellbore wherein a portion of the gas is separated from the mixture. The separated gas is then injected into the formation with remainder of the mixture being returned to the surface. Again, by using this method, no gas compressors are needed at the surface but the production well must be shut-in during the injection of the gas.

SUMMARY OF THE INVENTION

The present invention provides a method and apparatus for producing an oil and gas production stream from a first subterranean zone through a wellbore while simultaneously injecting gas into a second subterranean zone through the same wellbore. The injected gas can be that from the production stream or may be from a separate source. Basically, the production stream is produced to the surface where gas is separated therefrom. Gas from the production stream and/or gas from a separate source is then mixed with a carrier fluid at the surface to form a carrier fluid-gas mixture which, in turn, is flowed back down the wellbore and a downhole separator to separate at least a portion of the gas from the carrier liquid-gas mixture. This separated gas is then injected into the second subterranean zone while the carrier fluid and any unseparated gas is mixed and commingled with the production stream before the combined streams are flowed to the surface.

More specifically, the present invention provides a method and an apparatus for producing an oil and gas stream from a first subterranean zone through a wellbore while simultaneously injecting gas into a second subterranean zone through said wellbore wherein the wellbore has a string of production tubing positioned therein which forms an annulus between the production tubing and the wellbore. An oil and gas stream is produced to said surface through the production tubing where it is separated into its gas, oil, and water components. The separated gas is mixed with a carrier fluid (e.g. water, brine, etc.) at the surface to form a carrier fluid-gas mixture which is then flowed down the annulus in the wellbore while the well is still being produced through the tubing string.

As the carrier fluid-gas mixture approaches the bottom of the annulus, it flow through a downhole separator (e.g. an inverted hydrocyclone separator) wherein at least a portion of the gas is separated from the carrier fluid-gas mixture. The separated portion of the gas is then injected into the second subterranean zone which lies adjacent the wellbore. The mixture of the carrier fluid and any unseparated gas is mixed with the production stream at the outlet of the hydrocyclone separator by means of a jet pump or the like to thereby mix and commingle the streams before they are flowed to the surface through the production tubing.

By forming a mixture with a dense, carrier fluid, the gas does not need to be compressed at the surface before it is injected down the wellbore. As will be appreciated, by reducing or eliminating the need for gas compressors, the costs involved in disposing of excess gas through injection are substantially reduced. Further, since the gas can be injected while the well is being produced, the well does have to be shut-in in order to disposed of excess gas.

BRIEF DESCRIPTION OF THE DRAWINGS

The actual construction, operation, and apparent advantages of the present invention will be better understood by referring to the drawings which are not necessarily to scale and in which like numerals refer to like parts and in which:

The FIGURE illustrates a well which is being produced while gas is simultaneously being injected into a subterranean formation through the same wellbore in accordance with the present invention.

BEST KNOW MODE FOR CARRYING OUT THE INVENTION

Referring more particularly to the drawing, the FIGURE discloses a production well 10 having a wellbore 11 which extends from the surface 12, through an injection or second zone 13, and into a production or first zone 13*a*. As will be understood in the art, zones 13 and 13*a* may lie in the same subterranean formation or may be separate formations as shown. As illustrated, wellbore 11 is cased with a string of casing 14 to a point slightly above the upper or injection zone 13. A liner 15 or the like has openings 16 (e.g. perforations or slots) adjacent injection zone 13 and a second set of openings 16*a* adjacent production zone 13*a*.

Liner 15 is suspended from the lower end of casing 14 and is closed at its lower end by cement plug 15*a* or the like. A packer 17 is provided near the top of liner 15 to block flow from around the outside of the liner into casing 14. While this is one well-known way to complete a well, it will be recognized that other equally as well-known techniques can be used without departing from the present invention: e.g., wellbore 11 may be cased throughout it entire length and then perforated adjacent both zones 13 and 13*a* or it may be completed "open-hole" adjacent these zones, etc.

A string of tubing 18 is positioned within casing 14 and extends from the surface substantially throughout the length of casing 14 and into liner 15. Packer 19 is positioned near the lower end of tubing 18 to block any flow in the annulus 20 between tubing 18 and casing 14 at that point. A separator (e.g. hydrocyclone 25) is positioned within tubing 18 at the lower end thereof. As seen in the FIGURE, hydrocyclone separator 25 is in an inverted position from that in which would normally be operated at the surface but could also be operated in other orientations, if desired.

Separator 25 can be affixed within tubing 18 and lowered therewith or, as will be understood, it can be lowered into the tubing on a wireline, coiled-tubing, or the like (not shown) and landed on a landing nipple or the like (not shown) within the tubing after the tubing 18 has been positioned within the wellbore. Hydrocyclone separator 25, as shown, is basically comprised of a housing 26 having inlet ports 27 and an outlet 28 at one end and a vortex finder 29 at the other end thereof. The inlet ports 27 in housing 26 align with ports or openings (unnumbered for the sake of clarity) in tubing 18 for a purposed described below. Seal means (e.g. packer 30) seals between the housing 26 and the inside of tubing 18.

As will be understood in the art, a hydrocyclone is a separator which is designed to impart a swirling or cyclonic motion to a flow stream as the stream flows through the hydrocyclone. This motion forces the denser or heavier component of the stream (oil, water, etc.) outward against the wall of the separator housing while squeezing the less dense or lighter component (gas) toward the vortex at the center of the housing. Generally speaking, the less dense or lighter component (gas) is taken off through the vortex finder 29 while the denser or heavier component (oil-water) is taken off through outlet 28.

A production sub or conduit 31 extends from the lower end of tubing 18 and terminates substantially adjacent production zone 13*a*. Conduit 31 has a reduced diameter portion 32 which extends through vortex finder 29 and substantially the entire length of housing 26, terminating substantially adjacent outlet 28. One or more openings (e.g. nozzles 33) are positioned near the upper end of reduced portion 32 to provide fluid communication between the inside and outside of conduit 31. A check valve 35 is positioned in the lower end of conduit 31 which permits flow only in an upward direction for a purposed described below.

In operation, an oil and gas production stream 40 (e.g. may contain water) is produced from a first or production zone 13*a* through perforations 16*a* into liner 15 and flows upward through check valve 35 into production conduit 31. Production stream 40 exits through nozzles 33 at the upper end of conduit 31, flows up to the surface through tubing 18, and into a three-phase separator 41 where stream 40 is separated into gas, oil, and water. The oil is removed through line 42 for further processing.

In accordance with the present invention, the effective density of the gas to be injected (e.g. gas from separator 41) is increased at the surface before it is fed down wellbore 11. This is done by blending a dense, carrier fluid (e.g. liquid) with the gas at the surface to form a mixture having a bulk density between that of the carrier fluid and that of the gas. Dense carrier fluids may include any fluids which will suspend the gas in the mixture but will then allow separation of at least a part of the gas as the mixture passes through hydrocyclone separator 25. For example, such carrier liquids may include water; water-based liquids with added/dissolved densifying materials (e.g. produced water such as that from separator 41, seawater, drilling muds, "well-kill" brines, etc. with or without corrosion inhibitors); oil-based liquids such as drilling muds or the like; petrochemicals such as glycol; stabilized or volatile crude oils; or esoteric fluids such as a "heavy media", i.e. suspensions of fine particles of metal or the like (e.g. a suspension of fine iron filings in water). The gas and the carrier liquid are mixed so that the density of the mixture, when flowed under pressure (i.e. pumped) down wellbore 11, will overbalance the bottom-hole pressure within injection zone 13, as will be more fully discussed below.

Again, referring to the FIGURE, gas from separator 41 is supplied to mixer 43 through line 44. In some instances, it may be desirable to supply additional gas from a separate source (not shown) through line 44*a*. As shown, the carrier liquid is the produced water which has been separated from the production stream 40 within separator 41 and is supplied to mixer 43 through line 45. Additional water or other carrier liquid can be supplied through line 45*a*, if needed or desired. The carrier liquid is pumped under pressure by pump 46 through line 47 into mixing chamber 43 or other mixing device to form a carrier liquid-gas mixture. A foaming agent (e.g. low concentrations of sulphonates, polysulphonates, long-chain alcohols) may be added to the mixture (e.g. within mixer 43) to prevent "slugging" as the mixture flows downward in tubing 18 as will be understood in the art.

This mixture (arrows 50) flows down tubing 18 and through tangential inlets 27 into hydrocyclone separator 25 where centrifugal force (i.e. cyclonic force) of the tangential flow within the hydrocyclone separator 25 causes at least a portion of the gas to separate from the mixture 50 as explained above. The separated gas (arrows 60) migrates toward the center of hydrocyclone 25 and exits through vortex finder 29. Packers 17 and 19 block any substantially upward flow of gas so it can only flow through openings 16 and into zone 13 as the gas accumulates and the pressure increases in within liner 15.

The dense carrier liquid plus any remaining gas mixture (i.e. carrier liquid-gas mixture, arrows 70) flows along the outside separator housing 26 and exits through outlet 28. The pressure of the carrier liquid-gas mixture 70 will normally be greater than the pressure of production stream 40 which could result in backflow of the carrier liquid-gas mixture within the hydrocyclone 25. However, the jet nozzles 33 act as a venturi jet pump which allows the carrier fluid-gas stream 70 to readily mix with production stream 40 so that the combined streams 40, 70 can be commingled and produced to the surface. Upon reaching the surface, the combined streams will flow into separator 41 where the separating and gas injection process is effectively repeated. It should be understood that carrier liquid may be added or removed from the circuit through line 45*a* as a particular situation may dictate.

In order to inject gas into zone 13, the pressure of the separated gas in liner 15 has to be greater than the pressure within zone 13. Accordingly, the pressure of the carrier liquid-gas mixture at the surface must be sufficient to overbalance the well pressure thereby allowing the mixture to flow down the wellbore 11. This pressure is dictated by the pressure of the gas supply. Given that pumping liquid is easier than compressing gas, the pressure of the liquid in line 45 is substantially matched to the available gas pressure. The liquid pressure is generated at the surface primarily by pump 46 as it pumps the carrier-liquid to mixer 43. By generating the necessary injection pressure through the pumping of liquid, gas compression is substantially reduced or eliminated thereby significantly reducing the costs involved in the gas injection operation.

What is claimed is:

1. A method for producing an oil and gas stream from a first subterranean zone through a wellbore while simultaneously injecting gas into a second subterranean zone through said wellbore, said wellbore having a string of production tubing positioned therein to thereby form an annulus between said production tubing and said wellbore, said method comprising:

producing said oil and gas stream Lo said surface through said string of production tubing;

mixing said gas to be injected with a carrier fluid at the surface to form a carrier fluid-gas mixture;

flowing said carrier-fluid-gas mixture down said annulus while producing said oil and gas stream;

separating at least a portion of said gas from said carrier fluid-gas mixture after said carrier fluid-gas mixture has flowed down said annulus;

injecting said separated portion of said gas into said second subterranean zone; and returning the mixture of said carrier fluid and any unseparated gas to said surface.

2. The method of claim 1 wherein said carrier fluid is selected from the group comprising water, brine, oil-based liquids, crude oil, a petrochemical liquid, and a heavy media.

3. The method of claim 1 including;

separating said unseparated gas from carrier fluid after said mixture is returned to the surface; and recycling said separated carrier fluid for mixing with said gas to be injected.

4. The method of claim 1 wherein said at least a portion of said gas is separated from said carrier fluid-gas mixture by flowing said mixture through a hydrocyclone separator downhole within said production tubing.

5. The method of claim 1 wherein said mixture of said carrier fluid and any unseparated gas is mixed and commingled with said oil and gas production stream before the commingled streams are produced to the surface.

6. Apparatus for producing a oil and gas production stream from a first subterranean zone through a wellbore and for simultaneously injecting gas into a second subterranean zone, said apparatus comprising:

a well having a wellbore extending from the surface into both said first and said second zones;

a string of tubing positioned within said wellbore for producing said oil and gas production stream, said tubing forming an annulus between said tubing and said wellbore;

a separator positioned within said tubing near the lower end thereof;

a mixer for mixing said gas with a carrier fluid at the surface to form a carrier fluid-gas mixture;

means for flowing said carrier fluid-gas mixture down said annulus and through said separator to thereby separate at least a portion of said gas from said mixture;

means for flowing said separated portion of said gas from said separator into said second subterranean zone; and means for flowing the mixture of said carrier fluid and any unseparated gas back to the surface through said string of tubing.

7. The apparatus of claim 6 wherein said separator is a hydrocyclone separator.

8. The apparatus of claim 7 including:

means for mixing and commingling said the mixture of said carrier fluid and any unseparated gas and said production oil and gas string before flowing said commingled streams to the surface through said string of production tubing.

9. The apparatus of claim 8 wherein said means for mixing and commingling said streams comprises:

a jet pump positioned at the outlet of said hydrocyclone separator.

10. The apparatus of claim 9 including:

a separator at the surface for separating gas from said commingled streams after said commingled streams are returned to the surface.

11. The apparatus of claim 6 wherein said separator is an inverted hydrocyclone separator.

* * * * *